US006726204B2

(12) United States Patent
Inoue

(10) Patent No.: US 6,726,204 B2
(45) Date of Patent: Apr. 27, 2004

(54) SYMBOL DISPLAY DEVICE FOR GAME MACHINE

(75) Inventor: Haruo Inoue, Tokyo (JP)

(73) Assignee: Dragon Co., Ltd., Tokyo (JP)

( * ) Notice: Subject to any disclaimer, the term of this patent is extended or adjusted under 35 U.S.C. 154(b) by 0 days.

(21) Appl. No.: 10/237,879

(22) Filed: Sep. 10, 2002

(65) Prior Publication Data

US 2004/0012145 A1 Jan. 22, 2004

(30) Foreign Application Priority Data

Jul. 17, 2002 (JP) ..... 2002-208580

(51) Int. Cl.[7] ..... A63B 71/00

(52) U.S. Cl. ..... 273/143 R; 463/16; 463/20; 463/30; 463/31; 463/32

(58) Field of Search ..... 273/143 R; 463/20, 463/16, 30, 31, 32

(56) References Cited

U.S. PATENT DOCUMENTS 5,395,111 A * 3/1995 Inoue ..... 273/143 R
5,584,764 A * 12/1996 Inoue ..... 463/20
5,609,524 A * 3/1997 Inoue ..... 463/20
5,695,188 A * 12/1997 Ishibashi ..... 273/143 R
5,722,891 A * 3/1998 Inoue ..... 463/20
5,752,881 A * 5/1998 Inoue ..... 463/20
5,803,451 A * 9/1998 Kelly et al. ..... 273/118 R
5,984,782 A * 11/1999 Inoue ..... 463/20
6,086,066 A * 7/2000 Takeuchi et al. ..... 273/143 R
6,126,165 A * 10/2000 Sakamoto ..... 273/143 R
6,142,874 A * 11/2000 Kodachi et al. ..... 463/20
6,142,875 A * 11/2000 Kodachi et al. ..... 463/20
6,398,220 B1 * 6/2002 Inoue ..... 273/142 R
6,471,588 B2 * 10/2002 Sakamoto ..... 463/20
6,554,703 B1 * 4/2003 Bussick et al. ..... 463/20
6,558,254 B2 * 5/2003 Baelocher et al. ..... 463/20

FOREIGN PATENT DOCUMENTS

JP 6-218092 8/1994

* cited by examiner

*Primary Examiner*—Benjamin H. Layno
*Assistant Examiner*—D Collins
(74) *Attorney, Agent, or Firm*—Young & Thompson

(57) ABSTRACT

In a game machine, a reel unit is disposed behind each display window. The reel unit has an outer reel and an inner reel which coaxially rotate. The inner reel carries plural inner symbols at a certain pitch. The outer reel carries plural but less outer symbols. The outer symbol has a larger size than the inner symbol, and is opaque. The outer symbol on the inner symbol hides the inner symbol. A symbol combination is formed of only plural inner symbols, or at least one of the inner symbols and at least one of the outer symbols.

10 Claims, 11 Drawing Sheets

SYMBOL DISPLAY DEVICE FOR GAME MACHINE

BACKGROUND OF THE INVENTION

1. Field of the Invention

The present invention relates to a symbol display device for a game machine, more especially, to a symbol display device including reel units of double reel type.

2. Description Related to the Prior Art

In a slot machine or a pachinko machine, a symbol display device is provided. The symbol display device includes plural, for example, three reels. On a periphery of each reels of the reel unit, different symbols are arranged. When a game starts, the three reels begin to rotate simultaneously. When the three reels stops rotating, the winning or the losing of the game is determined, based on the three symbol combinations. In the slot machine having of the symbol display device a three-reels type, three symbols are displayed on each of the reels in a display window. Therefore a total number of the symbol to be displayed is nine. Before starting the slot game, a number of the winning lines to be activated is determined corresponding to a number of inserted coins. Thereafter, when the symbol combination for winning is displayed on the activated winning line, a predetermined number of coins are discharged corresponding to a kind of the symbol combinations.

In the reel unit, there is a double-reel type including an inner reel and an outer reel. In the symbol display device of the double-reel type, the symbol on the inner reel and a hit symbol on the outer reel form a synthesized symbol. Accordingly, a number and kinds of the symbols and the number of the symbol combinations become larger without increasing a diameter of the inner and outer reels.

However, in the symbol display device of the double-reel type, as a diameter of the inner reel is a different from the outer reel, it is hard to adjust positions of stopping the inner and outer reels for forming the synthesized symbol. Further the synthesized symbol is formed when the symbol on the outer reel disposed on the hit symbol of the inner reel. However, when a losing symbol of the outer reel is disposed on the symbol of the inner reel, the synthesized symbol is not formed. In this case, the appearance of the symbol of the outer reel becomes worse because of the simple disposure of one of the two symbols on the another one.

Further, in a double-reel type of the symbol display device disclosed in Japanese patent Laid-Open Publication No. 6-218092, several kinds of symbols are arranged on a periphery of an inner reel, and an outer reel is made of a light shielding material and has plural display openings. When the display opening stops in a display window, the symbol of the inner reel is displayed through the display opening. Accordingly, the player has relatively larger interests for in what position the display opening will be stopped, and what symbol can be displayed between the cover portions. In the symbol display device of the above publication, as the outer reel makes the symbol of the inner reel selectively display, the kinds of the symbol combinations does not become larger. Accordingly, there is a limit for exciting the player so much in performing the slot game.

SUMMARY OF THE INVENTION

An object of the present invention is to provide a symbol display device in which a symbol of an outer reel hides a symbol of an inner reel when the symbol of the outer reel is disposed on the symbol of the inner reel.

Another object of the present invention is to provide a symbol display device in which an appearance of the symbol of the outer reel does not becomes worse when the symbol of the outer reel is disposed over the symbol of the inner reel.

Still another object of the present invention is to provide a symbol display device in which performance of a game is moreover varied in the priority of the outer reel to the inner reel while the outer reel stops after the inner reel.

In order to achieve the object and the other objects, a symbol display device of the present invention has an inner reel carrying plural inner symbols on a periphery thereof and an outer reel carrying plural but less outer symbols on a periphery thereof than the inner symbols. The inner reel is disposed inside of the outer reel to construct a reel pair. The outer reel has a larger size than the inner reel, and areas surrounding the outer symbols are transparent. When the outer symbol is disposed on the inner symbol, the outer symbol hides the inner symbol.

In a game machine, a plurality of the reel pairs is provided, and the outer symbol and the inner symbol are observable through a display window. After the inner reels each stop rotating, the outer reels each start and stop rotating. Based on the kind of a symbol combination complete on a winning line, the winning or the losing of the game is determined. The symbol combination is constructed of only plural inner symbols or at least one inner symbol and at least one outer symbol.

BRIEF DISCRIPTION OF THE DRAWINGS

The above objects and advantages of the present invention will become easily understood by one of ordinary skill in the art when the following detailed description would be read in connection with the accompanying drawings.

PREFERRED EMBODIMENTS OF THE INVENTION

Figure 1:
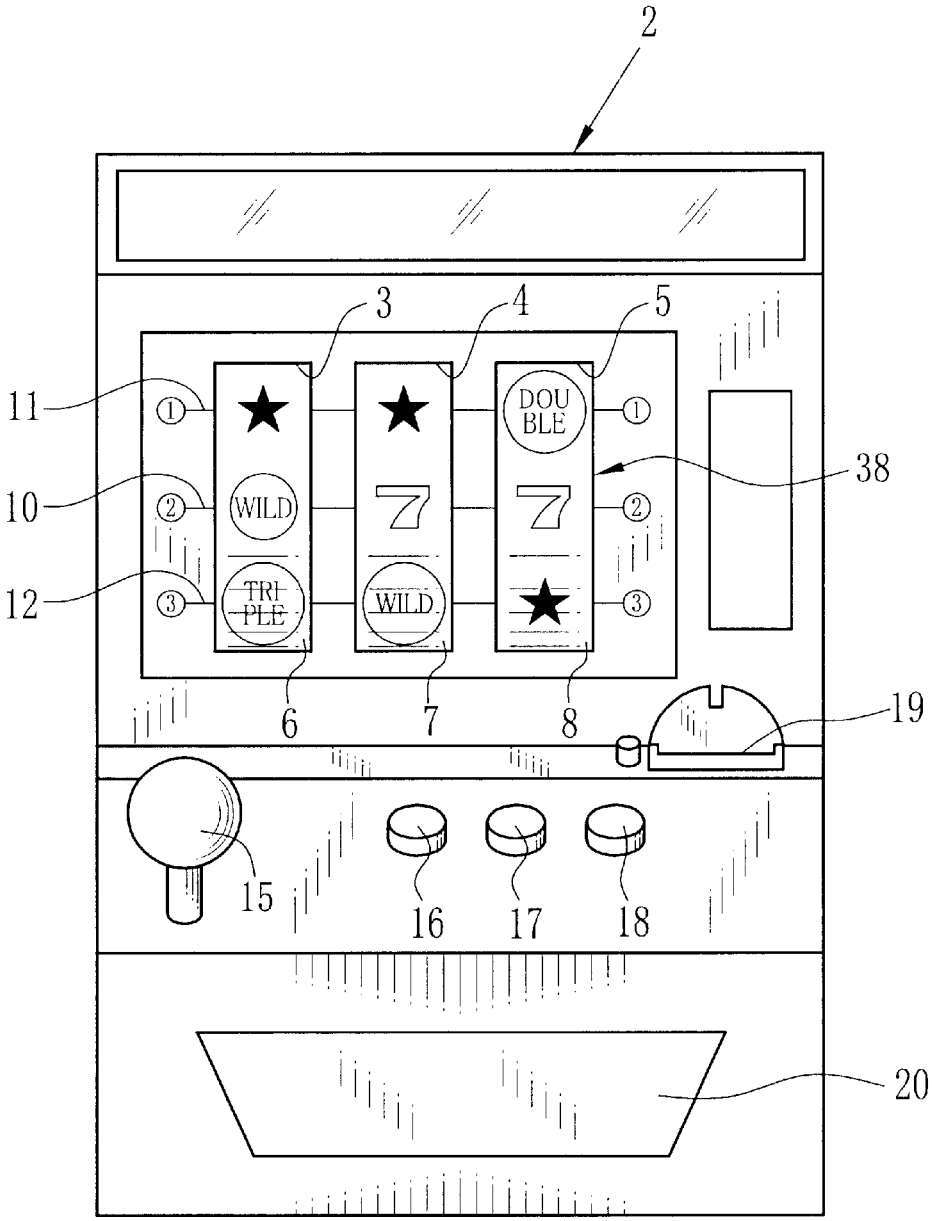
FIG. 1 is a front view of a slot machine in which a symbol display device of the present invention.

In FIG. 1, a slot machine 2 is provided with a symbol display device 38 in a center thereof. The symbol display device 38 is constructed of three display windows 3–5 and first—third reel units behind the display windows. The reel units include a first reel pair 6, a second reel pair 7 and a third reel pair 8 respectively. Through each of the display windows 3–5, three of inner symbols 28–32 and outer symbols 35–37 (see FIG. 3) of the first—third reel pairs can be observed. Three winning lines 10–12 are provided horizontally.

Below the display windows 3–5 there are a start lever 15, a stop button 16, a bet button 17, a discharge button 18 and a coin slot 19. Behind the coin slot 19, a coin sensor 45 (see, FIG. 4) is provided for detecting coins (including token and medal) inserted through the coin slot 19 to activate the winning lines in response to inserting the coins one by one. For example, when one of the coins is inserted, a winning line 10 is activated. When two of the coins are inserted, the winning line 10 and the upper line 11 are activated. When three of the coins are inserted, the winning lines 10–12 are activated.

After inserting the coins, the start lever 15 is operated so that the first—third reel pairs start rotating simultaneously. Then, when the stop button 16 is depressed, the first—third reel pairs 6–8 stop. A winning or a loss of the slot game is acknowledged in accordance with a symbol combination in which the symbols are arranged on activated one of the winning lines 10–12. In case of the complete of the symbol combination for winning, the player can obtain dividend coins of a number predetermined to a rank of the winning.

Figure 2:
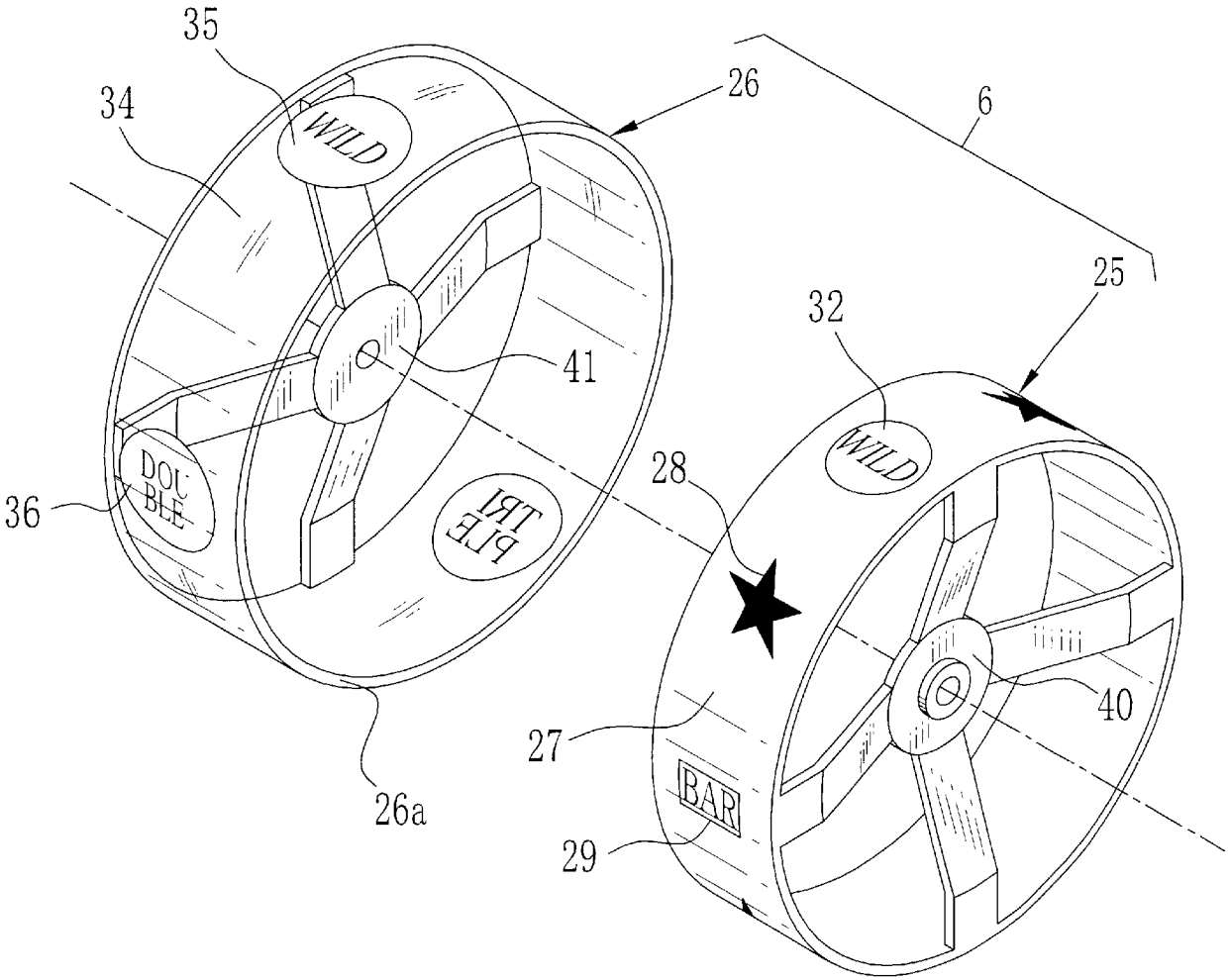
FIG. 2 is a perspective view of an inner reel and an outer reel of the symbol display device.

In FIG. 2, the first reel pair 6 is constructed of an inner reel 25 and an outer reel 26. The inner reel 25 consists of a reel body formed of opaque plastic, and a symbol sheet 27 wound around a periphery of the inner reel 25. The symbol sheet 27 is formed of white and opaque plastic. The outer reel 26 is formed of a transparent plastic, and on a periphery of the outer reel 26 a symbol sheet 34 is wound. The symbol sheet 34 is formed of transparent plastic.

In the inner reel 25 and the outer reel 26, disk-like portions 40, 41 are formed respectively. Through the disk-like portions 40, 41, the inner reel 25 and the outer reel 26 are connected respectively to stepping motors 58, 61 (see, FIG. 4). The inner reel 25 and outer reel 26 are coaxially provided and rotate and stop individually. Note that as the reel pairs 7, 8 has a same structure as the reel pair 6, the explanation of them is not made.

Figure 3:
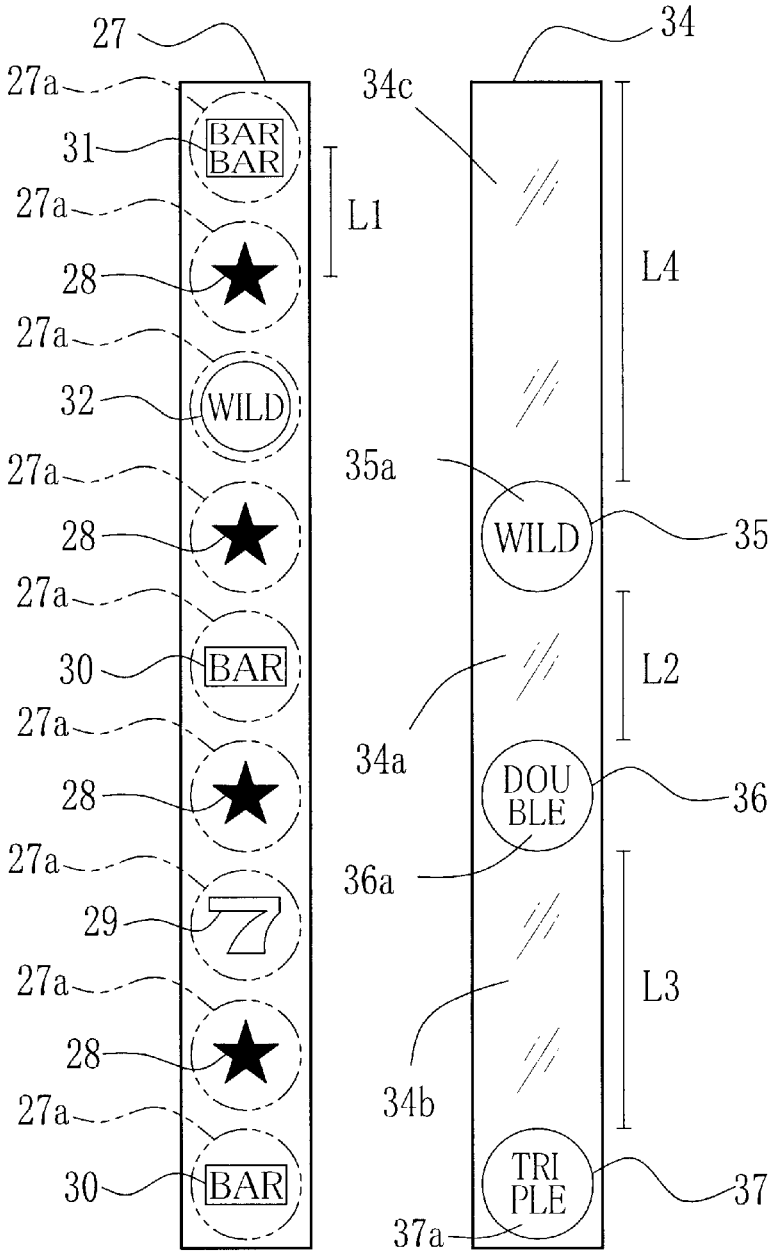
FIG. 3 is a plan view of symbol sheets for outer and inner reels.

As shown in FIG. 3, on the symbol sheet 27 for the inner reel 25, the symbols 28–32 are printed in a same pitch L1. Further, on the symbol sheet 34 for the outer reel 26, the outer symbols 35–37 are printed. As the inner reel 25 has a smaller diameter than the outer reel 26, the symbol sheet 27 is shorter than the symbol sheet 34 in real. However, in FIG. 3, in order to illustrate the deposition of the outer symbol on the inner symbol, the symbol sheets 27 and 34 are illustrated so as to have a same length. On the symbol sheet 34, there is a transparent blank portion 34*a* having a length L2 between the outer symbol 35 and the outer symbol 36. The length L2 is enough that the blank portion 34*a* cover one of the inner symbols 28–32. There is a transparent blank portion 34*b* having a length L3 between the outer symbol 36 and the outer symbol 37. The length L3 is such that the blank portion 34*b* cover two of the inner symbols 28–32. There is a transparent blank portion 34*c* having a length L4 between the outer symbol 35 and the outer symbol 37. The length L4 is such that the blank portion 34*c* cover three of the inner symbols 28–32.

Further, the outer symbols 35–37 are opaque in order to hide the inner symbols 28–32 disposed under them. Namely, spaces 35*a*, 36*a*, 37*a* between outlines and words are opaque. These outer symbols 35–37 have a same size and are larger than the inner symbols 28–32 of the symbol sheet of the inner reel. Accordingly, when the outer symbols 35–37 are disposed on the inner symbols 28–32, an equivalent area 27*a* illustrated with chain dotted-dashed line is covered with the outer symbols 35–37. In this case, the symbols 28–32 covered with the symbols 35–37 cannot be observed.

In this embodiment, at least one of the first—third reel units may includes a reel pair having the inner reel 25 and the outer reel 26.

As the inner symbols of the inner reel 25, there are "STAR" 28, "7" 29, "BAR" 30, "BAR BAR" 31, "WILD" 32 and the like. The inner symbol "STAR" 28 is a losing symbol having no relation to the winning of the game. The inner symbol "WILD" 32 is an almighty hit symbol which is regarded as another of the inner symbols 28–31 on the inner reel 25. Namely, when the symbol combination "WILD-7-7" (see, FIG. 1) is completed on the central winning line 10 by the inner symbols 29 and 32, the inner symbol "WILD" 32 is regarded as the inner symbol "7" 29, and therefore the player wins. Further, when the symbol combination "WILD-WILD-7" is complete, it is regarded as "7-7-7" also. Further, the symbol combination "WILD-WILD-WILD" is determined as a special symbol combination such that more of the dividend coins are discharged.

As the outer symbols of the outer reel 34, there are "WILD" 35, "DOUBLE" 36 and the "TRIPLE" 37, which all are almighty symbols. The outer symbol "WILD" 35 complete the symbol combination for winning with the inner symbols of the inner reel 25. The outer symbols "DOUBLE" 36 and "TRIPLE" 37 make a rank of the symbol combination for the winning higher. When the symbol combination for winning contains the symbol "DOUBLE", the number of the dividend coins becomes twice larger, and when the symbol combination for winning contains the symbol "TRIPLE", the number of the dividend coins becomes three times larger. When the symbol combination for winning contains two of the symbols 36 "DOUBLE", for example in case of "BAR-DOUBLE-DOUBLE", the number of the dividend coins is four times larger than in case of "BAR-BAR-BAR". Further, in case of "BAR-DOUBLE-TRIPLE", the number of the dividend coins is six times larger than in case of "BAR-BAR-BAR". When "DOUBLE-DOUBLE-DOUBLE" is displayed as the symbol combination, the number of the dividend coins is the second largest, and when the "TRIPLE-TRIPLE-TRIPLE" is displayed, the number of the dividend coins is the largest.

In the second and third reel pairs 7, 8, the symbol sheets 27, 34 are wound on the inner reel 25 and the outer reel 26. In the symbol sheets 27 and 34, kinds, number and arrangement of symbols may be changed. Furthermore these may be different between the three reel units. Note that the kinds of hit and the dividends number may be set so as to be adequate for the game condition.

Figure 4:
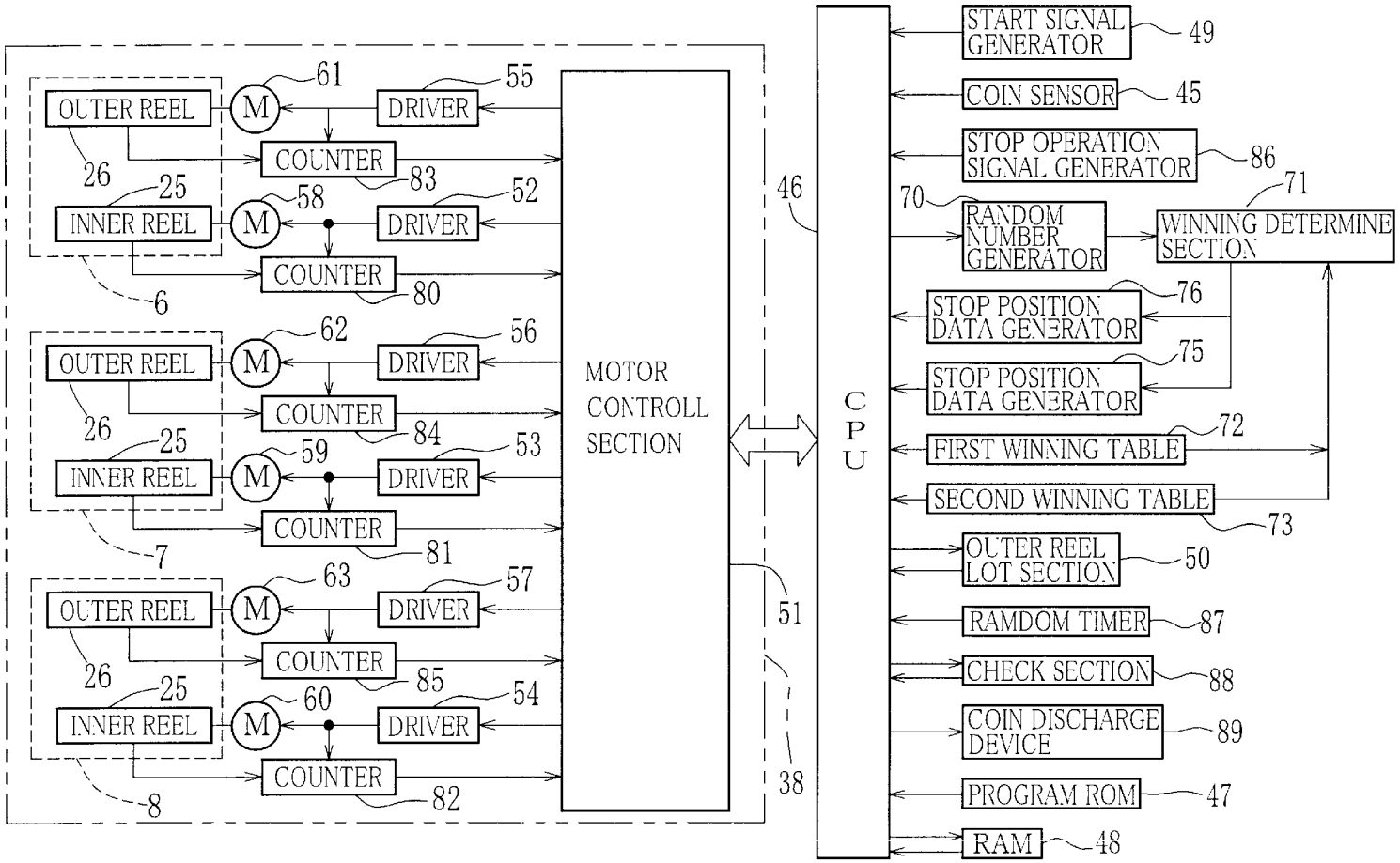
FIG. 4 is a block diagram illustrating an electric structure of the slot machine.

As shown in FIG. 4, the coin sensor 45 generates a detection signal by detecting a coin inserted through the coin slot 19, to send the detection signal to a CPU 46. The CPU 46, which receives the detection signal, activates one of the winning lines 10–12. Thus the winning lines 10–12 are activated in the same number of the inserted coins. Then in the CPU 46, a data of the number of the inserted coin is temporary stored in a RAM 48. Note that the CPU 46 controls the drive of the slot machine 2 according to a game program in a program ROM 47, and ignores operation signals having no relation with a procedure of the slot game.

When the start lever 15 is operated, a start signal generate section 49 is set in an ON situation, and a start signal is input in the CPU 46. When the start signal is input, the CPU 46 generates a lot start signal to input it in an outer reel lot section 50 constructed of a random number generator and a random number sampling circuit. In the outer reel lot section 50, a lot table is stored. When the outer reel lot section 50 receives the lot start signal, the outer reel lot section 50 samples the random number, and compares the random number with the lot table for determining whether the outer reel 26 will be rotated.

Otherwise, in response to the start signal, the CPU 46 generates a random number generate signal to input it in a random number generator 70. The random number generator 70 is driven to sample a win-determination random number and send it to a winning determine section 71. In the winning determine section 71, the win-determination random number is, when rotation of only the inner reel 25 is designated without the outer reel 26, compared with a first winning table 72, and when rotation of both of the inner and outer reels 25 and 26 is designated, compared with a second winning table 73.

Each of the first and second winning tables 72, 73 has a winning random number group and a losing random number group. In the second winning table 73, the winning random number group is constituted of first, second and third sub-groups. The first sub-group is used for displaying of the symbol combination for winning only on the outer reel 26. The second sub-group is used for completing the symbol combination for winning only on the inner reel 25. The third sub-group is used for completing of the symbol combination for winning on both of the inner and outer reels 25, 26. Note that a plurality of the symbol combination for winning is not completed at a same time in the slot machine 2.

When rotation of only the inner reel 25 is designated, the CPU 46 actuates a stop position data generator 75. When rotation of the inner and outer reel 25, 26 is designated, the CPU 46 actuates also a stop position data generator 76.

The stop position data generators 75, 76 input into the CPU 46 a stop position data according to rotational positions of the stepping motors 58–60 and 61–63 respectively. The stop position data is thereafter stored in a RAM 48.

When rotation of the inner reel 25 is designated, the CPU 46 outputs a motor drive start signal to a motor control section 51. The motor control section 51 drives the stepping motors 58–60 through the drivers 52–54 to rotate the inner reels 25 of the first—third reel pairs 6–8. When the stop button 16 is depressed, a stop operation signal is output from a stop operation signal generator 86 to the CPU 46. When receiving the stop operation signal, the CPU 46 generates a motor stop signal to send it to the motor drive section 51.

When rotation of the outer reel 26 is designated, the motor control section 51 drives the stepping motors 61–63 through the drivers 55–57 to rotate the outer reels 26 of the first—third reel pairs 6–8. After a predetermined time, the CPU 46 generates an outer reel stop indication signal to send it to the motor drive section 51. The stepping motors 58–63 are rotated for unit step angles in response to drive pulses input through the driver 52–57. The drive pulses are counted with counters 80–85.

The inner and outer reels 25, 26 are provided with fragments (not shown) used for detecting a reference rotational position. Rotation of each of the fragments is observed with a photo interrupter, and when the fragment rotates once, the photo interrupter generates a reset signal to send it to the counters 80–85. Then the number of the pulses, counted with the counters 80–85, is reset to zero. Further, a relative position of each of the symbols 28–32 and 35–37 to the fragment is determined, and therefore the relative position is represented by a number of pulses that is counted after reset of thereof.

In order to stop the rotation of the inner reels 25, the CPU 46 reads out a stop position data from the RAM 48. When the number of the pulses is as same as the stop position data, the CPU 46 stops the drive of the stepping motors 58–60. Further, in order to stop the rotation of the outer reels 26, when predetermined time passes after starting the rotation of the outer reels 26, the CPU 46 drives a random timer 87. The random timer 87 randomly generates an outer reel stop instruction signal for the each of the first—third reel pairs 6–8, and inputs the outer reel stop instruction signal into the CPU 46. After generating the outer reel stop instruction signals for respective outer reels 26, the CPU 46 receives from the RAM 48 the stop position data generated in the stop position data generator 76. When the number of the pulses is as same as the stop position data, the CPU 46 stops the drive of the stepping motors 61–63 and the rotation of the outer reel 26. Thus the three outer reels stops sequentially in response to the three outer reel stop instruction signals.

When the first—third reel pairs 6–8 stops, the check section 88 checks whether the symbol combination for winning is complete, based on the number of the pulses that is counted with the counters 80–85. Normally, the complete symbol combination is as same as that determined with use of the first and second winning tables 72, 73. However, as the stepping motor 58–63 sometimes rotates irregularly, the other symbol combination is complete than the determined one. When the check section 88 makes certain that the symbol combination for winning is complete, a coin discharge device 89 discharges the number of the dividend coins in accordance with the symbol combination for winning.

Figure 5:
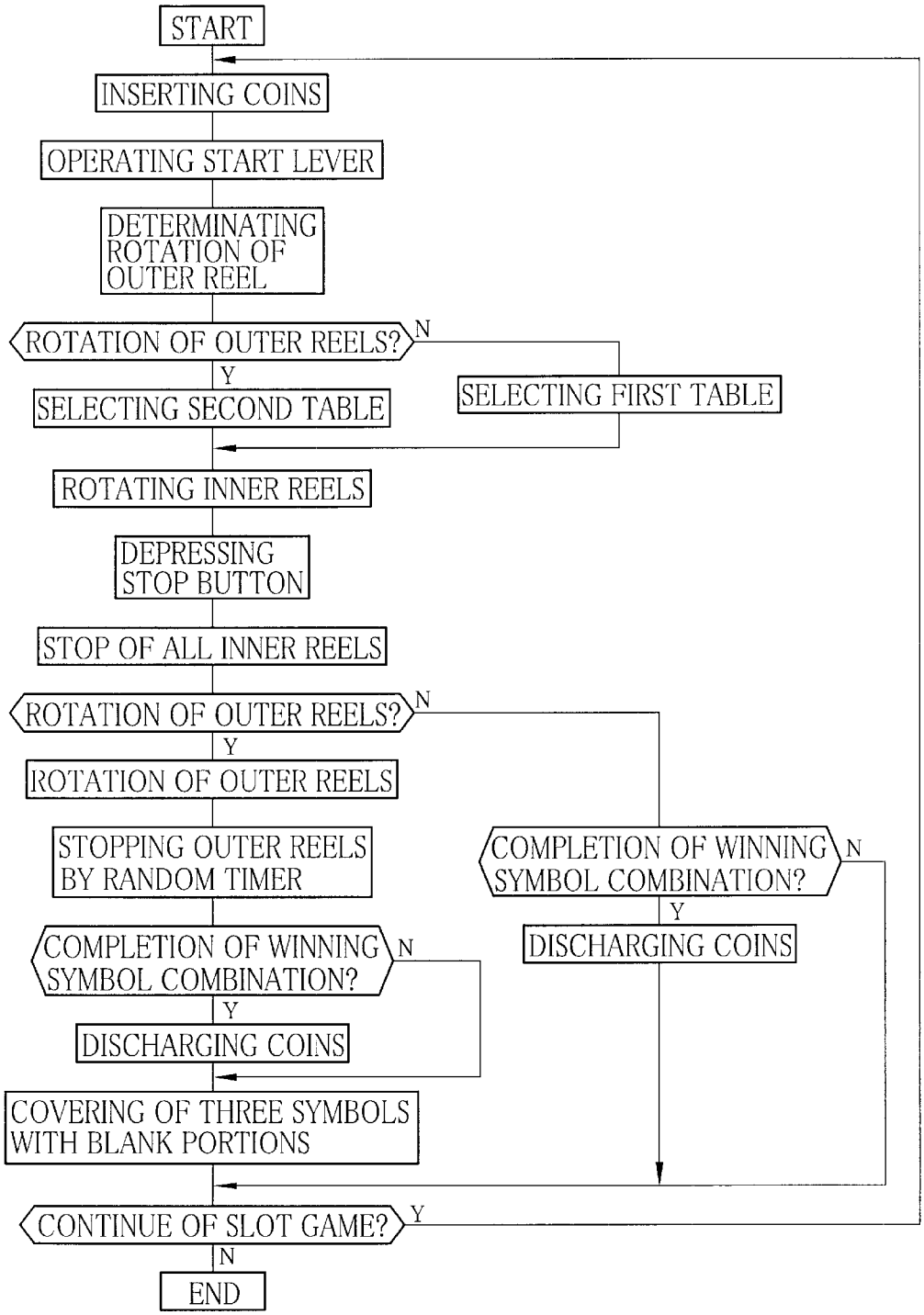
FIG. 5 is a flow chart illustrating processes of a slot game.

Operations of the above embodiment will be described now. When the slot game begins, the outer reels 26 of each of the first—third reel pairs 6–8 stop such that the blanks 34*c* having a length of three symbols may appear. In FIG. 5, after inserting the coins from the coin slot 19 to activate one or more of the winning lines, the player operates a start lever 15. Then the CPU 46 determines whether to rotate the outer reel 26.

When no rotation of the outer reel 26 is designated, the random value generated in the random number generator 70 of the CPU 46 is compared with the first table 72, and the win or the loss is determined. When rotation of the outer reel 26 is designated, the win-determination random number is compared with the second table, and the win or the loss is determined. In case of winning the game, the symbol combination for winning to be completed is determined, and in case of losing the game, the symbol combination for losing to be completed is determined. Then the CPU 46 drives the motor control section 51 to rotate the inner reels 25 of the first—third reel pairs 6–8 simultaneously. Thereafter, when the player depress the stop button 16, the CPU 46 stops through the motor drive section 51 the inner reels 25 of the first—third reel pairs 6–8 sequentially.

When no rotation of the outer reel 26 is designated, the check of the symbol combination complete on the winning line is carried out by the check section 88 after stopping all of the inner reels 25. When the symbol combination for winning is complete, the dividend coins whose number corresponds to the rank of the winning are discharged. Note that in the case of the loss, the dividend coins are not discharged.

When rotation of the outer reel 26 is designated, the outer reels 26 of the first—third reel pairs 6–8 begin to rotate. After a predetermined time, the CPU 46 drives the random timer 87 and controls to randomly stop the outer reels 26 for each of the first—third reel pairs 6–8. In the case of the winning, the dividend coins whose number which corresponds to the rank of the winning are discharged. Thereafter, the outer reels 26 is rotated such that the blank portions 34*c* having the length for three of the outer symbols may appear.

Figure 6A:
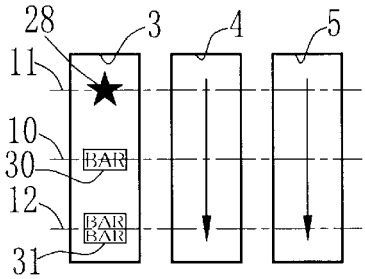
FIGS. 6A–6G are explanatory views illustrating a stop situation of the first, second and third reel pairs stop.
Figure 6B:
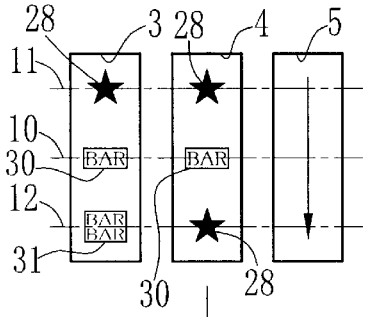
Figure 6C:
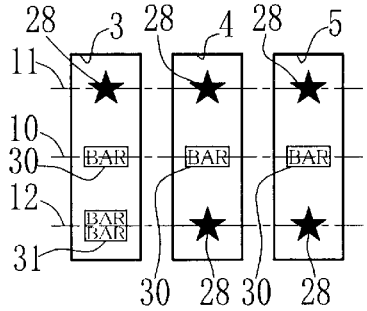

There is a case in which the symbol combination for winning is constructed only of the inner symbols 28–32 on the inner reel 25. For example, the inner symbol "BAR" 30 constructs the symbol combination "BAR-BAR-BAR". As shown in FIG. 6A–6C, the inner reels 25 stops in the three display windows 3–5 sequentially such that the symbol 30 "BAR" may be disposed on the winning line 10. In FIG. 6C, it is observed through the blank portion 34*c* of the outer reel 26 that the symbol combination "BAR-BAR-BAR" is complete.

Figure 6D:
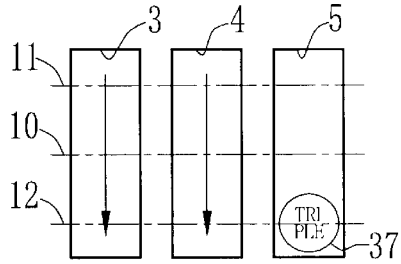

The outer reel 26 starts rotating in the three display windows 3–5. First, the outer reel 26 stops in the display window 5, and the inner symbol 28 "STAR" on the winning line 12 in FIG. 6C is covered, as shown in FIG. 6D, with the outer symbol "TRIPLE", and becomes not to be observable. Further, there is a difference of stop positions between the inner reel 25 and the outer reel 26. However, as the outer symbol 37 is formed to be larger than the inner symbol 28, a part of the inner symbol 28 does not appear from edges of the outer symbol 37.

Figure 6E:
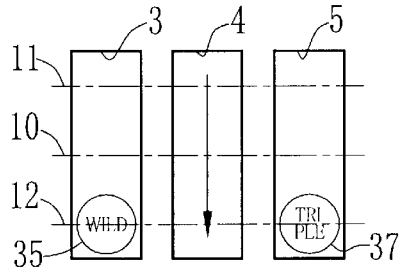
Figure 6F:
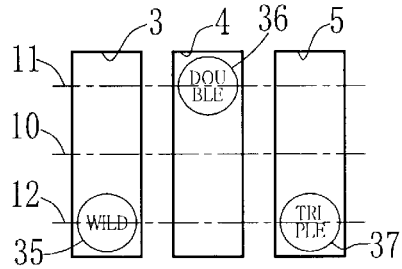

Then the outer reel 26 stops in the display window 3, and as shown in FIG. 6E, the outer symbol "WILD" 35 appears on the winning line 12. At least, the outer reel 26 stops in the display window 4, and as shown in FIG. 6F, the outer symbol "DOUBLE" 36 appears on the winning line 11.

Figure 6G:
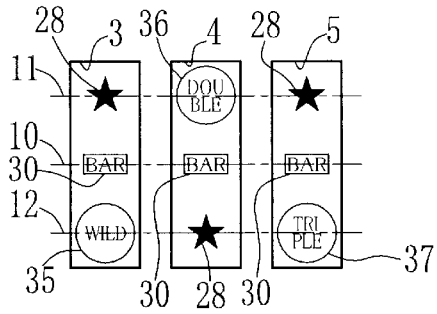

After stop of the six reels, as shown in FIG. 6G, the symbol combinations are complete as "STAR-DOUBLE-STAR" on the winning line 11 and "WILD-STAR-TRIPLE" on the winning line 12. However, as the inner symbol "STAR" 28 is the losing symbol, the symbol combinations on the winning lines 11, 12 do not mean the winning. Otherwise, as the symbol combination "BAR-BAR-BAR" is constructed of only the inner symbols "BAR" 25, the player wins the slot game.

Figure 7A:
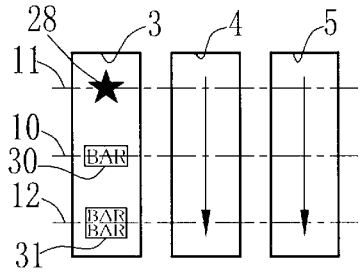
FIGS. 7A–7G are explanatory views as same as FIGS. 6A–6F.
Figure 7B:
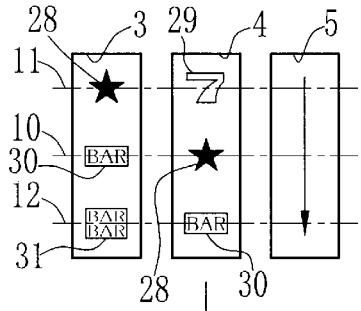
Figure 7C:
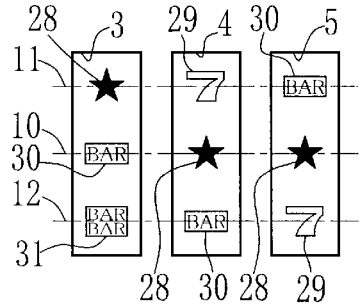
Figure 7D:
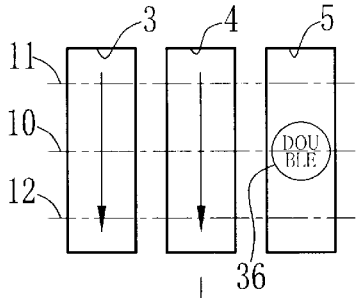
Figure 7E:
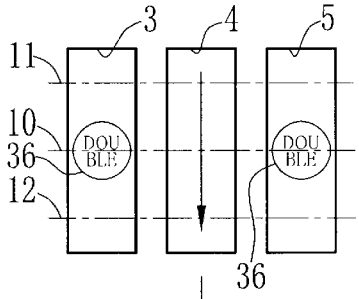
Figure 7F:
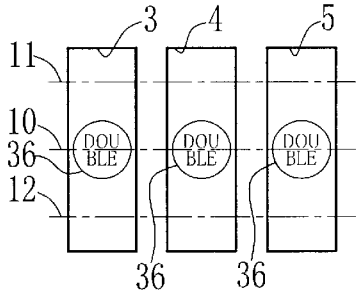
Figure 7G:
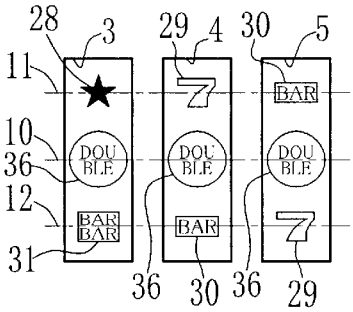

There is another case in which the symbol combination for winning is constructed only of the outer symbols 35–37 on the outer reel 26. For example, the outer symbol 36 "DOUBLE" constructs the symbol combination "DOUBLE-DOUBLE-DOUBLE". As shown in FIG. 7A–7C, the inner reels 25 stops in the three display windows 3–5 sequentially. In FIG. 7C, the symbol combination for winning is not complete. Then the outer reels 26 of the first—third reel pairs begin rotating at the same time. The inner symbols "STAR" 28 and "BAR" 30, which are dispose on the winning line 10 in FIG. 7C, are covered with the symbols 36 "DOUBLE" of the outer reel 26 in FIG. 7D, when the outer reel 26 stops in the display window 5. Thereafter, as shown in FIGS. 7E and 7F, the outer reels stop in the display windows 3 and 4 sequentially. Consequently, as shown in FIG. 7G, the symbol combination is completed with symbols of the six reels, and the symbol combination for winning, "DOUBLE-DOUBLE-DOUBLE", is completed.

Figure 8A:
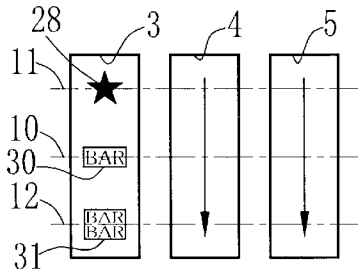
FIGS. 8A–8G are explanatory views as same as FIGS. 6A–6F.
Figure 8B:
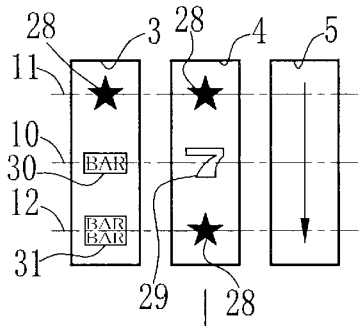
Figure 8C:
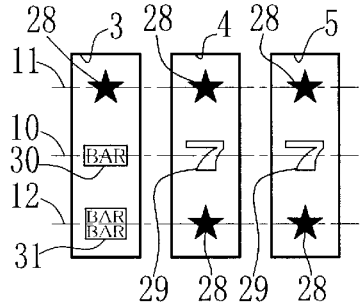
Figure 8D:
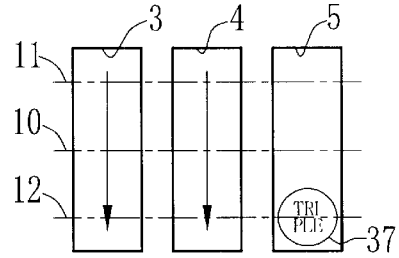
Figure 8E:
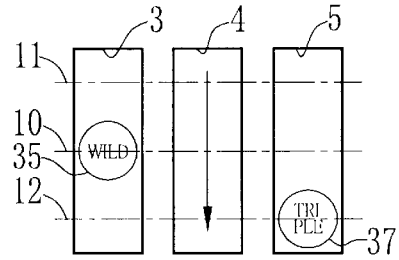
Figure 8F:
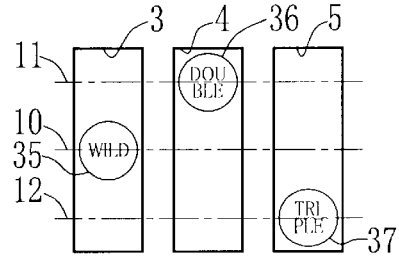
Figure 8G:
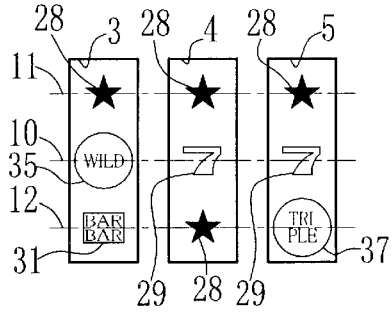

There is further a case in which the symbol combination for winning is completed of both the inner symbols 29–32 and the outer symbols 35–37. As shown in FIG. 8A–8C, the inner reels 25 stop in the three display windows 3–5 sequentially. In FIG. 8C, the symbol combination for winning is not complete. On the winning line 10, the inner symbol "BAR" 30 appears in the display window 3, and the inner symbols "7" 29 appear in the display windows 4,5 such that a Riich condition (or extra luck condition) generates. Then the outer reels 26 begin rotating in the display windows 3–5, at the same time. As shown in FIG. 8D, when the outer reel 26 stops in the display window 5, the inner symbol "7" 30 is disposed under the blank, and therefore observed through the blank portion. As shown in FIG. 8E, when the outer reel 26 stops in the display window 3, the inner symbol "BAR" 30 is covered with the outer symbol "WILD" 35. As shown in FIG. 8F, when the outer reels 26 stops in the display window 4, the inner symbol "7". 29 is observable through the blank portion of the outer reel 26. Accordingly, in FIG. 8G, the symbol combination "WILD-7-7" is complete on the winning line 10. Note that the arrangement in the symbol combination may be varied, for example into "7-WILD-7" or "7-7-WILD".

Figure 9A:
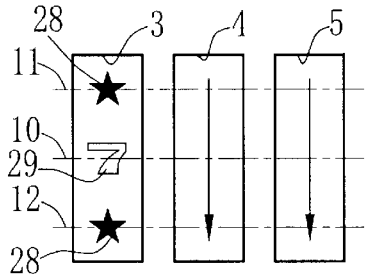
FIGS. 9A–9G are explanatory views as same as FIGS. 6A–6F.
Figure 9B:
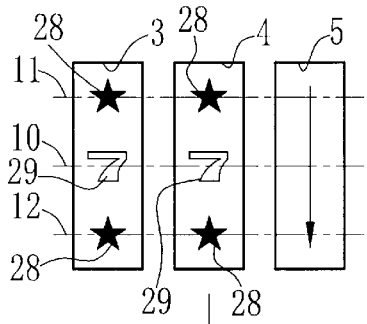
Figure 9C:
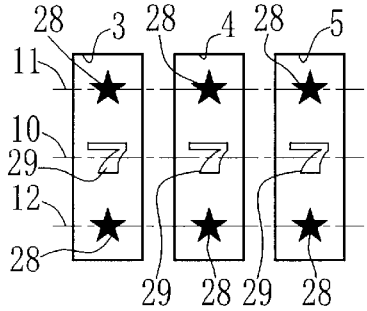
Figure 9D:
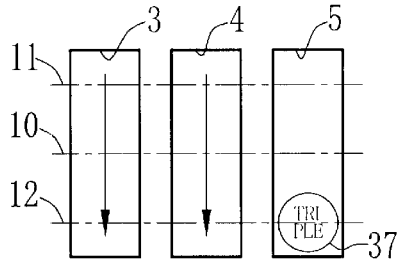
Figure 9E:
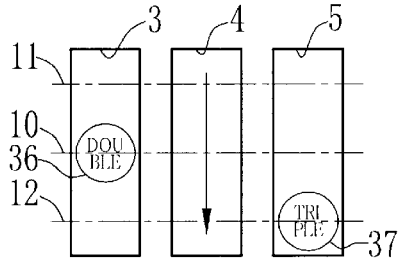
Figure 9F:
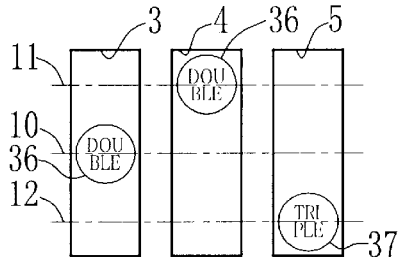
Figure 9G:
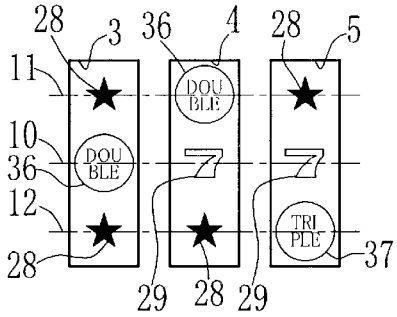

In completion of the symbol combination for winning after rotation of the inner reel 25, the three outer symbols may cover the symbol combination to complete another symbol combination for winning newly. In FIG. 9C, the inner symbols 29 complete the symbol combination for winning "7-7-7" on the winning line 10. Then the outer reels 26 begin rotating in the display windows 3–5. When the outer reels stop as shown in FIGS. 9D–9F, the inner and outer symbols are arranged as shown in FIG. 9G, and the symbol combination for winning "DOUBLE-7-7" is completed on the winning line 10. In the display window 3, the inner symbol "7" 29 is covered with the outer symbol "DOUBLE" 36, and in the display windows 4 and 5, the inner symbol "STAR" 28 is covered with the outer symbols "DOUBLE" 36 and "TRIPLE" 37 respectively. Note that the arrangement in the symbol combination may be varied, for example into "7-DOUBLE-7" or "7-7-DOUBLE".

In this embodiment of the present invention, the outer reels 26 rotate after stop of the inner reels 25. Accordingly, when the symbol combination for winning is not completed by stopping all of the inner reels 25, the player can continually have expectations for the winning before stopping all of the outer reels 26. Further, whenever the symbol combination for winning is not completed after stop of all the inner reels 25, the player can moreover expect for winning the game after stopping all of the outer reels 26.

Figure 10:
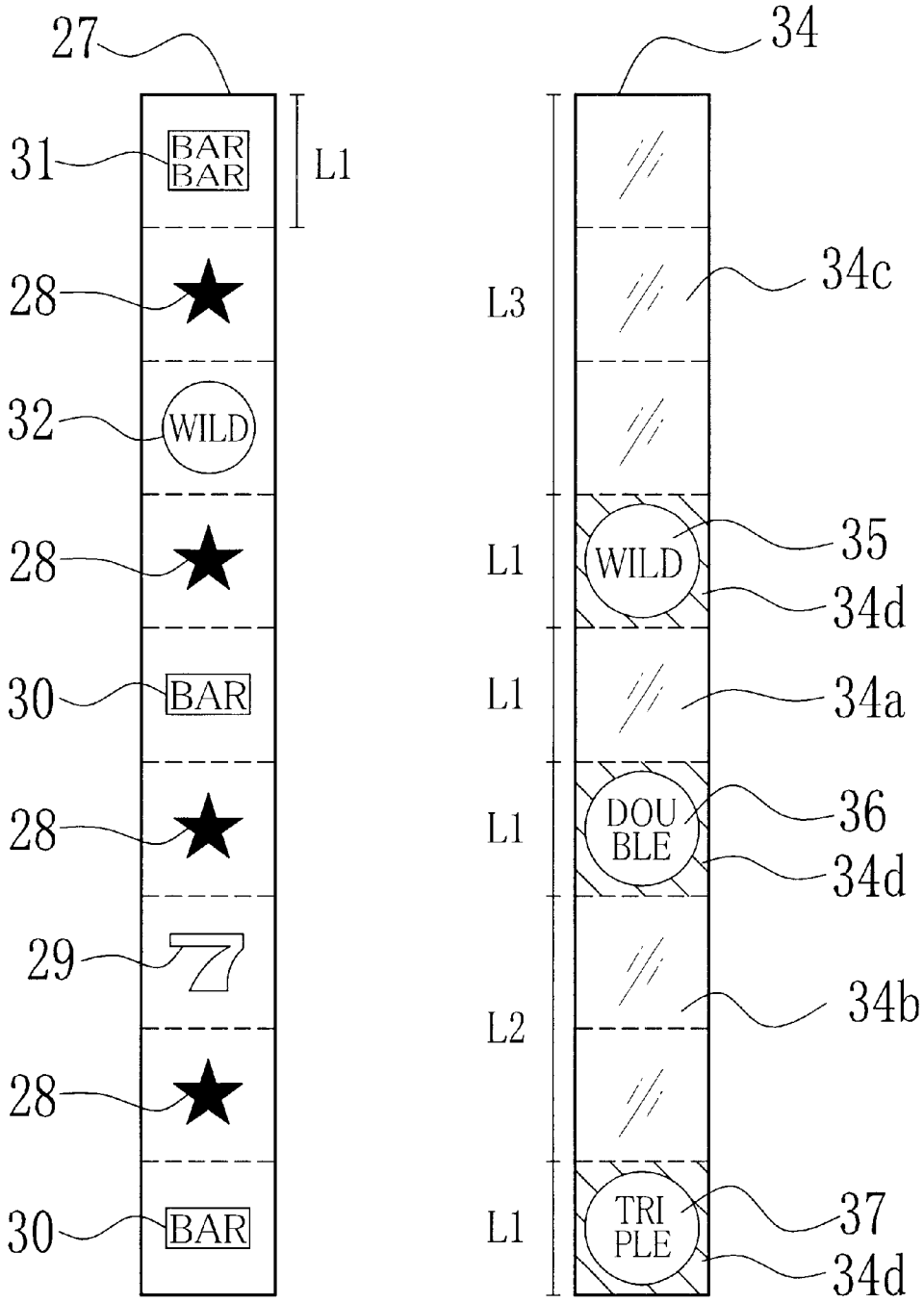
FIG. 10 is a plan view illustrating the second embodiment of the symbol sheet for the inner and outer reels.

FIG. 10 illustrates another embodiment of the symbol sheet 34 of the outer reel 26. The symbol sheet 34 is separated into a same number of imaginary frames as the inner symbols 28–32 on the symbol sheet 27 for the inner reel 25. The imaginary frame for printing the outer symbols 35–37 is formed of opaque materials as the opaque area 34*d*. Accordingly, even when there is a difference of the stop position between the outer reel 26 and the inner reel 25, the opaque area 34*d* covers the symbols 28–32 of the inner reels 25. Note that broken lines on the symbol sheets 27, 34 imaginary illustrate edges of the imaginary frame, and are not provided in real. Further, to the same structures as in FIG. 3 the same numerals, are applied and the explanation therefore is not repeated.

Figure 11:
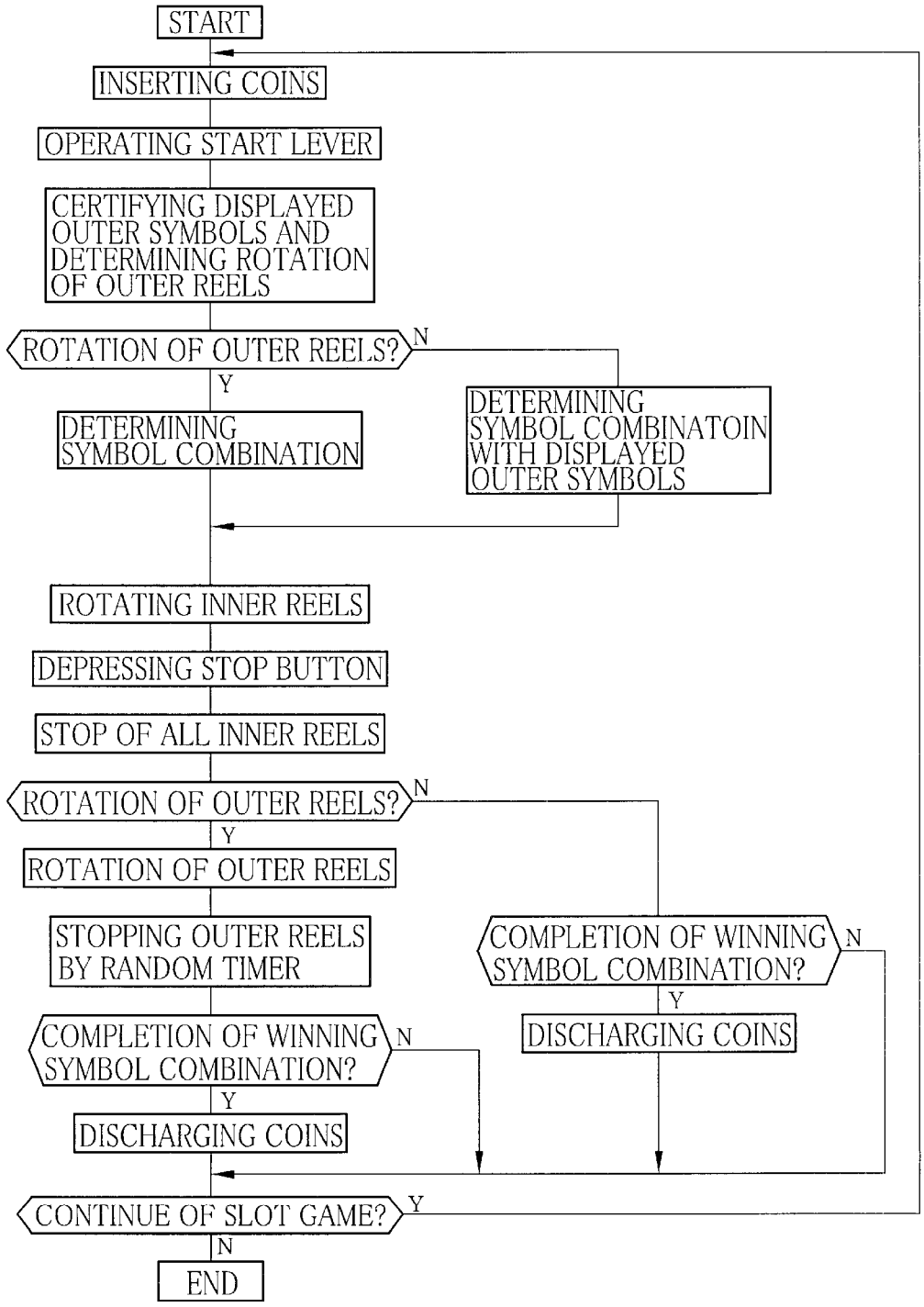
FIG. 11 is a flow chart illustrating a process of the slot game of an embodiment in which the inner reel rotates without setting the outer reel to an initial position.

In the present invention, the slot game may be carried out in a situation of stop of the outer reel without rotating the outer reel 26 in an initial position. In this case, as shown in FIG. 11, after inserting the coins, the player operates of the start lever 15. Then the CPU 46 discriminates what of the outer symbols 35–37 of the outer reels 26 is displayed in the display windows, with reference of the count number of the counters 83–85, and determines whether the outer reel 26 will be rotated. When no rotation of the outer reel 26 is designated, the symbol combination to be completed is determined with taking in consideration of displayed ones of the outer symbols 35–37 of the outer reels 26. Note that the outer reel 26 is driven as same as FIG. 5, and an explanation therefore is omitted.

The outer reels 26 may be rotated when a condition is complete. For example, the outer reel 26 is rotated when a predetermined symbol combination is complete. Further, when the same symbol combination is complete predetermined times, rotation of the outer reel 26 can be designated in the next slot game. Furthermore the outer reel 26 is rotated in each of the slot game without determination thereof. The outer reels 26 may be rotated with the inner reels 25.

The first—third reel pairs 6–8 may be automatically stopped without depression of the stop button 16. In this case, a control program to stop the first—third reel pairs 6–8 is provided for respective controls of them. Thereby the order and timing of stopping the first—third reel pairs 6–8 may be set to be adequate for performing the slot game.

The inner symbols 28–32 of the inner reel 25 may be printed on the symbol sheet 34 for the outer reel 26. For example, a symbol "STAR" may be provided with the outer reel 26. When the outer reel 26 rotates after completing by the inner reels 25 the symbol combination "7-7-7," for the winning, the symbol "STAR" on the outer reel 26 sometimes covers one of the symbols "7" on the inner reel 25 such that the symbol combination for winning becomes that for losing.

The number of the winning lines may not be three but can be set adequately. Further the relation of the number of the inserted coins to the number of the activated winning lines is also not restricted in the embodiment. Further, the slot machine may have a credit counter for storing the number of the dividend coins before discharging thereof by depressing the discharge button. In this case, when the bet button 17 is depressed, the winning line is activated, and the number of the dividend coins stored by the credit counter becomes smaller, according to the number of the activated winning lines.

Further, the pitch of the inner symbols may not only determined but also different in accordance with the kind of the inner symbols. Furthermore, the outer symbol may have so large a size as to bridge plural, for example, two of the winning lines. The outer symbol of the larger size conceals two inner symbols on the two winning line, and is effective on the two winning lines.

In the above embodiment, each of the first—third reels is constructed of the inner reel and the outer reel. However, the present invention is not restricted in it, and accordingly, the number of the reel unit having the inner and outer reels may be changed in consideration of performance of the game.

In the above embodiment, after determining the winning with reference of the sampled random numbers, each of the reels are controlled so as to complete the determined symbol combination. However, the symbols to be displayed may be determined with reference of the sampled random number, and thereafter, each reels may be controlled such that the determined symbols may be displayed. Thereby the symbol combination is completed, and the judgment of the winning is carried out in accordance with the completed symbol combination.

Further, the symbol display device 38 may be loaded in the pachinko machine, namely pinball machine of an upright type, or other game machines.

Various changes and modifications are possible in the present invention and may be understood to be within the present invention.

What is claimed is:

1. A symbol display device for game machine, in which symbol combinations are observable through a display window, said symbol display device comprising:

plural reel units disposed behind said display window, said reel unit including an inner reel and an outer reel that are coaxially rotatable, said inner reel and said outer reel independently rotating and stopping;

a periphery of each of said inner reel and said outer reel, said periphery of said inner reel overlapping with said periphery of said outer reel;

plural transparent portions and plural opaque portions that are formed on said periphery of said outer reel;

plural inner symbols formed on said periphery of said inner reel, and said inner symbols being observable through said transparent portion of said outer reel in said display window;

plural outer symbols formed on said opaque portion, said outer symbols being observable in said display window instead of said inner symbols hidden by said opaque portions; and at least one winning line disposed across said display window, at least one of said symbol combinations being completed by a combination of said outer symbols and said inner symbols which are disposed under said transparent portions, which are arranged on said winning line.

2. A symbol display device as claimed in claim 1, wherein said plural inner symbols are arranged at a same pitch on said periphery of said inner reel.

3. A symbol display device as claimed in claim 2, wherein a number of said outer symbols is smaller than a number of said inner symbols.

4. A symbol display device as claimed in claim 3, wherein a size of said opaque portion is as same as that of said one outer symbol and larger than that of said one inner symbol.

5. A symbol display device as claimed in claim 3, wherein a size of said opaque portion is larger than that of said one outer symbol and said one inner symbol such as to hide said one outer symbol and said one inner symbol.

6. A symbol display device as claimed in claim 5, wherein said opaque portion has a tetragonal shape, and said tetragonal shape is formed by imaginary separating said periphery of said outer reel at a pitch according to said pitch of said inner symbols.

7. A symbol display device as claimed in claim 3, wherein at least one of said transparent portions has a largest size, and said largest transparent portion has a size corresponding to a size of said display window not so as to hide said plural inner symbols in said display window.

8. A symbol display device as claimed in claim 7, wherein said outer reel is rotated before starting a game, and said largest transparent portion is opposed to said display window.

9. A symbol display device as claimed in claim 1, wherein said outer reel is rotated and stopped after stopping rotation of said inner reel.

10. A symbol display device as claimed in claim 3, wherein said outer symbols contain a hit symbol and a rank-up symbol, said hit symbol completes an symbol combination for winning with said plural inner symbols, and said rank-up symbol makes a rank of winning higher when said inner symbol complete said symbol combination for winning.

* * * * *